United States Patent [19]

Ewing

[11] 4,333,129

[45] Jun. 1, 1982

[54] FLASHLIGHT WITH BATTERY SEPARATOR

[76] Inventor: Charles W. Ewing, 7923 Portal, Houston, Tex. 77017

[21] Appl. No.: 172,760

[22] Filed: Jul. 28, 1980

[51] Int. Cl.[3] ..... F21L 7/00

[52] U.S. Cl. ..... 362/205; 362/201; 362/295; 362/375; 362/157

[58] Field of Search ..... 362/201, 205, 295, 375, 362/157

[56] References Cited

U.S. PATENT DOCUMENTS 2,522,012 9/1950 Alexander ..... 362/205

*Primary Examiner*—Stephen J. Lechert, Jr.

*Attorney, Agent, or Firm*—Pravel, Gambrell, Hewitt, Kirk, Kimball & Dodge

[57] ABSTRACT

A physical and electrical separation of the batteries in a conventional flashlight is achieved by placing a separator plate between the batteries. The separator plate, of a non-conductive material, has a first and second side, each with a conductive coating which is not in electrical communication. A second switch means connects the two sides when placed in the "on" position.

6 Claims, 7 Drawing Figures

FIG. 5
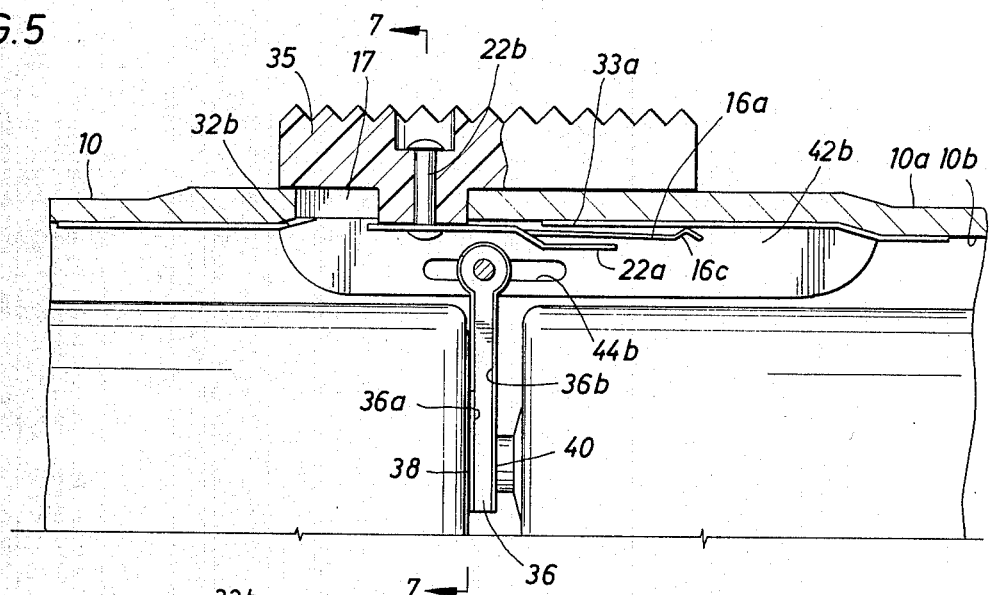
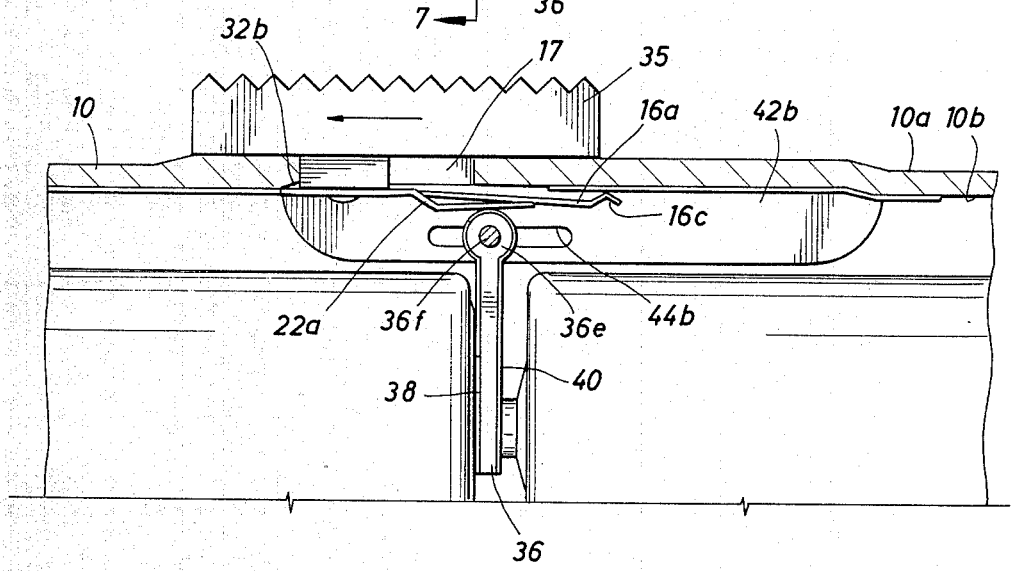
FIG. 6
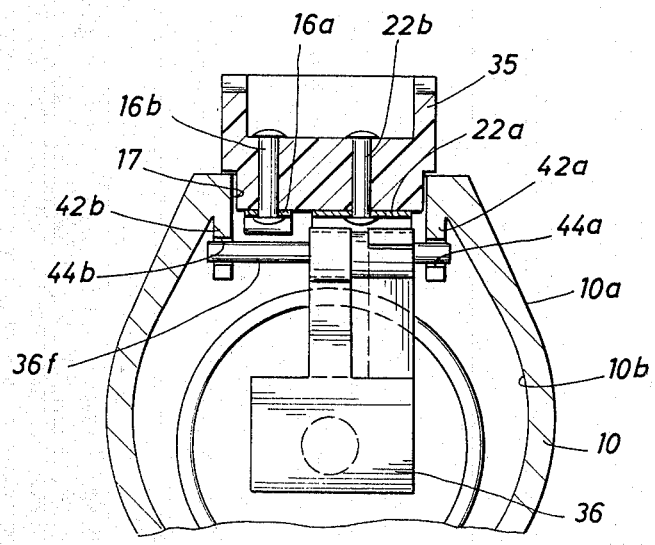
FIG. 7

FLASHLIGHT WITH BATTERY SEPARATOR

FIELD OF INVENTION

This invention relates to flashlights. More specifically, this invention relates to flashlights with apparatus for the prevention of direct physical and electrical contact between the batteries.

PRIOR ART

Handheld flashlights with a housing, a plurality of batteries, a lightbulb, and a switch are well known in the art. One problem associated with such flashlights is that there may be a reaction between terminals of batteries in electrical contact, even when there is not a complete circuit, causing corrosion, deterioration of the batteries and possible harm to the flashlight as the batteries age. Certain flashlights, such as that described in U.S. Pat. No. 2,449,568, disclose batteries physically separated and having no direct terminal to terminal contact. However, the batteries are not electrically separated but are only physically separated for other reasons and, therefore, do not solve the problems associated with electrical contact. Other patents such as U.S. Pat. No. 4,151,583 disclose a switch which physically and electrically separates the battery terminals at their normal interface but leave a continuous electrical contact along an outer electrical circuit giving rise to the same problem. U.S. Pat. No. 2,816,215 discloses a folding flashlight which also physically prevents electronic contact along the normal connecting path but does allow continuous electrical connection along an exterior path. Therefore, the inventor knows of no patents which provide a complete physical and electronical separation of the batteries.

SUMMARY OF THE INVENTION

A physical and electronical separation of flashlight batteries is created by the installation of a separator plate between the normally connecting terminals of the batteries. The separator plate has conductive material on each side which contacts a terminal of a battery but the conductive materials do not make electrical connection with each other until a switch is placed in its "on" position completing the normal circuit and connecting the conducting surfaces of the separator plate. Means are provided for loading the batteries.

DESCRIPTION OF THE DRAWINGS

FIG. 5 is a view of the switch in the off position.

FIG. 6 is a view of the switch in the on position.

FIG. 7 is a cross-sectional view of the flashlight along line 7—7 of FIG. 5.

DESCRIPTION OF THE PREFERRED EMBODIMENT

Figure 1:
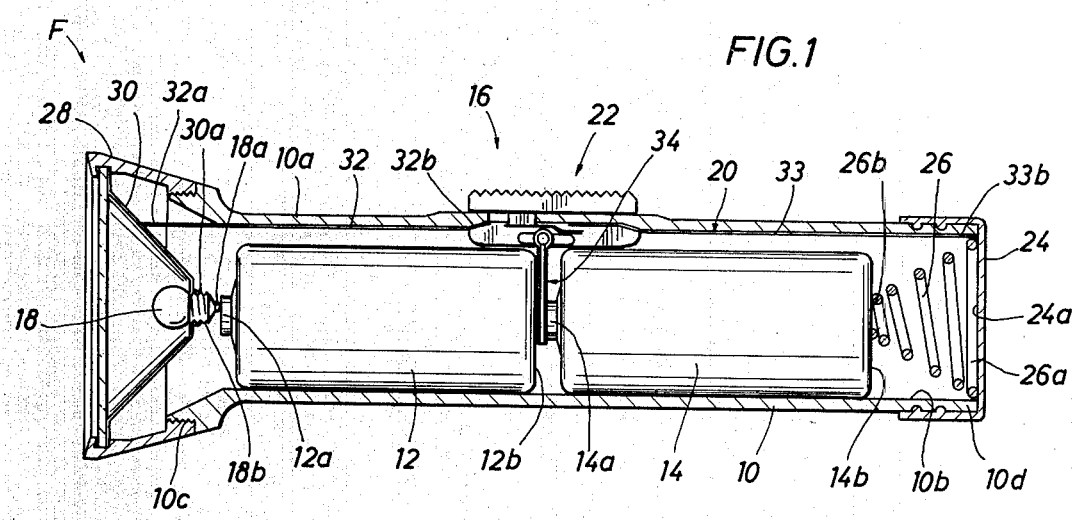
FIG. 1 is a view of the flashlight in cross-section.

Referring to FIG. 1, the preferred embodiment F of the present invention includes the conventional flashlight structure of a flashlight housing 10, a first battery 12 with a first terminal 12*a* and a second terminal 12*b*, a second battery 14 also with a first terminal 14*a* and a second terminal 14*b*, a first switch means 16 mounted with the housing 10, a bulb 18 mounted within the housing 10 and circuit means 20 for making an electrical circuit including the second battery 14, the first battery 12, the bulb 18 and the switch 16. The first terminals 12*a* and 14*a* have an opposite charge from second terminals 12*b* and 14*b*. The first switch means 16 has a first or "on" position, as shown in detail in FIG. 6, which allows electrical communication between the first terminal 12*a* of the first battery 12 and the second terminal 14*b* of the second battery 14. When the first switch means 16 is in its second or "off" position, as seen in FIG. 5, electrical communication between the first battery first terminal 12*a* and a second battery second terminal 14*b* is prevented. The improvement of the present invention includes a second switch means 22 mounted with the flashlight housing 10 which allows electrical communication between the second terminal 12*b* of the first battery 12 and the first terminal 14*a* of the second battery 14 when in a first or "on" position physically and electrically separates the first battery second terminal 12*b* and the second battery first terminal 14*a* when in a second or "off" position. Thereby, when the first switch means 16 and the second switch means 22 are in their off positions, the first 12*a* and second 12*b* terminals of first battery 12 and the first 14*a* and second 14*b* terminals of the second battery 14 are physically and electrically separated and there is no contact between the terminals.

In greater detail, the flashlight F of the preferred embodiment includes the generally cylindrical housing 10 with an exterior wall 10*a*, an interior wall 10*b*, a front end 10*c* and a back end 10*d*. Mounted with the back end 10*d* is flashlight cap 24 which is threadedly connected to the housing cylinder 10. A conical spring 26 of a conductive material is placed within the housing 10 so as to rest against the interior base 24*a* of cap 24. The wide end 26*a* of the spring makes electrical contact with the cap 24. The narrow end 26*b* of spring 26 makes electrical contact with the second terminal 14*b* of second battery 14. A reflector housing 28 is threadedly engaged with front end 10*c*. Reflector 30 is mounted in reflector housing 28 and is formed with a bulb mount 30*a* in which bulb 18 is mounted. Bulb 18 has a first contact 18*a* and a second contact 18*b*. Contact 18*a* is in physical and electrical contact with the first battery first terminal 12*a*. Second contact 18*b* is in electrical contact with the reflector bulb mount 30*a*.

Circuit means 20 includes forward strip 32 which is mounted along the housing interior wall 10*b* and, at its front end 32*a*, electrically connects to reflector 30 and, at its back end 32*b*, is adjacent to first switch means 16. Circuit means 20 also includes rearward strip 33 which is mounted along housing interior wall 10*b* and at its front end 33*a* is adjacent to first switch means 16 and, at its back end 33*b*, electrically connects to cap 24.

The first switch means 16 is mounted on and through housing 10. Seen in more detail in FIGS. 5, 6 and 7, the first switch 16 includes a slide plate 35 which is mounted for slideable movement along housing 10 on the exterior wall 10*a*. The first switch connecting strip 16*a* is mounted for slideable movement along the housing interior wall 10*b*. Slide plate 35 and connecting strip 16*a* are held together and upon the housing by brad 16*b* which causes them to move simultaneously. Brad 16*b* is mounted through hole 17 formed in housing 10 which limits the movement of slide plate 35. The connecting strip 16*a* is of a conductive material and, when the first switch means 16 is in the first or "on" position, as shown in FIG. 6, connects forward strip back end 32*b* and rearward strip front end 33*a* of circuit means 20 to form an electrical circuit. When the first switch means 16 is in its second position, as seen in FIG. 5, forward strip back end 32*b* and rearward strip front end 33*a* of circuit means 20 are not electrically connected and the circuit is broken. First switch means connecting strip 16*a* is preferably formed with bend 16*c* to ensure good electrical contact.

Figure 3:
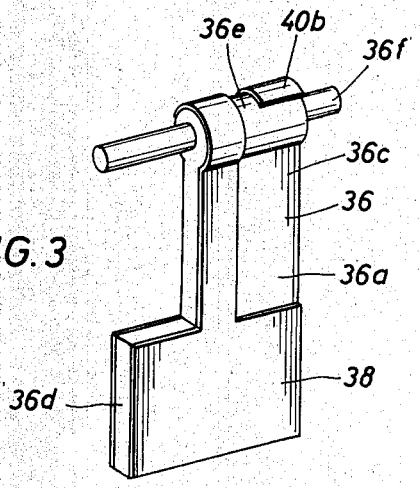
FIG. 3 is a view of one side of the separator plate.
Figure 4:
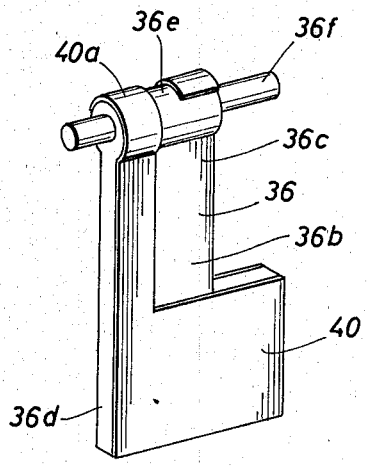
FIG. 4 is a view of the opposite side of the separator plate.

The second switch means 22 includes a separator means 34, mounted within housing 10, physically and electrically separating the first battery second terminal 12*b* from the second battery first terminal 14*a*. The separator means 34 includes a separator plate 36 which is made of a non-conductive material, such as a plastic, and has a first side 36*a* and a second side 36*b*, as seen in FIGS. 3 and 4 respectively. The first and second sides 36*a* and 36*b* of separator plate 36 are substantially covered with a conductive substance by any of the many means well known in the art but, preferably, by gluing of metallic linings 38 and 40 respectively. Although covering substantial portions of the separator plate 36, the metallic linings 38 and 40 do not electrically communicate, as shown in FIGS. 3 and 4. The separator plate 36 may be variously shaped but is preferably of a generally L-shaped form having a leg 36*c* and a base 36*d*. At the top of the leg 36*c* is a cylindrical portion 36*e* through which runs axle 36*f* used to mount the separator plate 36 in the housing 10. The metallic linings 38 and 40 each have a portion running along the separator plate leg 36*c* which is wrapped substantially around the separator plate cylinder 36*e*. Thereby, a portion, 38*a* and 40*a* respectively, of the metallic strips 38 and 40 are in relatively close proximity along the cylinder 36*e* without touching. Those portions 38*a* and 40*a* in proximity are used to make electrical contact between the two metallic linings 38 and 40.

The second switch means 22 in the preferred embodiment is mounted on housing 10 with the first switch means 16 and uses slide plate 35 for moving from a first or "on" position to a second or "off" position. As seen in greater details in FIGS. 5 through 7, the second switch means 22 also includes a second switch means brad 22*b* which holds a connecting strip 22*a* and the slide plate 35 to the exterior wall 10*a* and interior wall 10*b* respectively through hole 17 and allows slideable movement. The connecting strip 22*a*, when in its first or "on" position as seen in FIG. 6, connects portions 38*a* and 40*a* of metallic linings 38 and 40, thereby completing an electrical circuit from the first side 36*a* to the second side 36*b* of the separator plate 36.

The separator plate 36 is mounted within the housing 10 between the first battery second terminal 12*b* and the second battery first terminal 14*a*. The metallic lining 38 on the separator plate first side 36*a* makes physical and electrical contact with the first battery second terminal 12*b*. The metallic lining 40 on the separator plate second side 36*b* makes physical and electrical contact with the second battery first terminal 14*a*. Therefore, when the connecting strip 22*a* of the switch means 22 is in the "on" position the metallic strips 38 and 40 and the connecting strip 22*a* provides an electrical connection between the two terminals. The first switch means connecting strip 16*a* and the second switch means connecting strip 22*a* are in a generally parallel and non-touching construction as seen in FIG. 7 so that there is no electrical connection between them.

The separator plate 36 is mounted within housing 10 in mounting parts 42*a* and 42*b*. Mounting parts 42*a* and 42*b* are generally rectangular sheets mounted or formed on the interior wall 10*b* parallel to each other and extending lengthwise along housing 10. Formed in mounting parts 42*a* and 42*b* are mounting slots 44*a* and 44*b*, respectively, in which is placed separator plate axle 36*f*. This allows separator plate 36 to have some motion along the length of housing 10 so as to adjust for movement of batteries 12 and 14 and, also, to have rotational motion about axle 36*f* for the purpose of loading batteries as explained below.

When slide plate 35 is moved so that first switch means 16 and second switch means 22 are in their "on" position, a complete electrical circuit is formed following a path which may be described by arbitrarily starting at the first terminal 12*a* of first battery 12 and proceeding along bulb first contact 18*a*, bulb second contact 18*b*, reflector hole 30*a*, reflector 30, circuit means forward strip front end 32*a*, circuit means forward strip back end 32*b*, first switch means connecting strip 16*a*, circuit means rearward strip front end 33*a*, rearward strip back end 33*b*, cap interior base 24*a*, spring wide end 26*a*, spring narrow end 26*b*, second battery second teminal 14*b*, second battery first terminal 14*a*, metallic lining 40 along separator plate second side 36, second switch means connecting strip 22*a*, metallic lining 38 along separator plate first side 36*a*, and first battery second terminal 12*b*. When the slide plate 35 is in its second or "off" position, the connecting strips 16*a* and 22*a* break the circuit at two points between circuit means forward strip rear end 32*b* and rearward strip front end 33*a* and between metallic linings 38 and 40 thereby preventing electrical or physical contact between the second battery first terminal 14*a* and second battery second terminal 14*b* and first battery second terminal 12*b* and second battery first terminal 14*a*.

Loading

Figure 2:
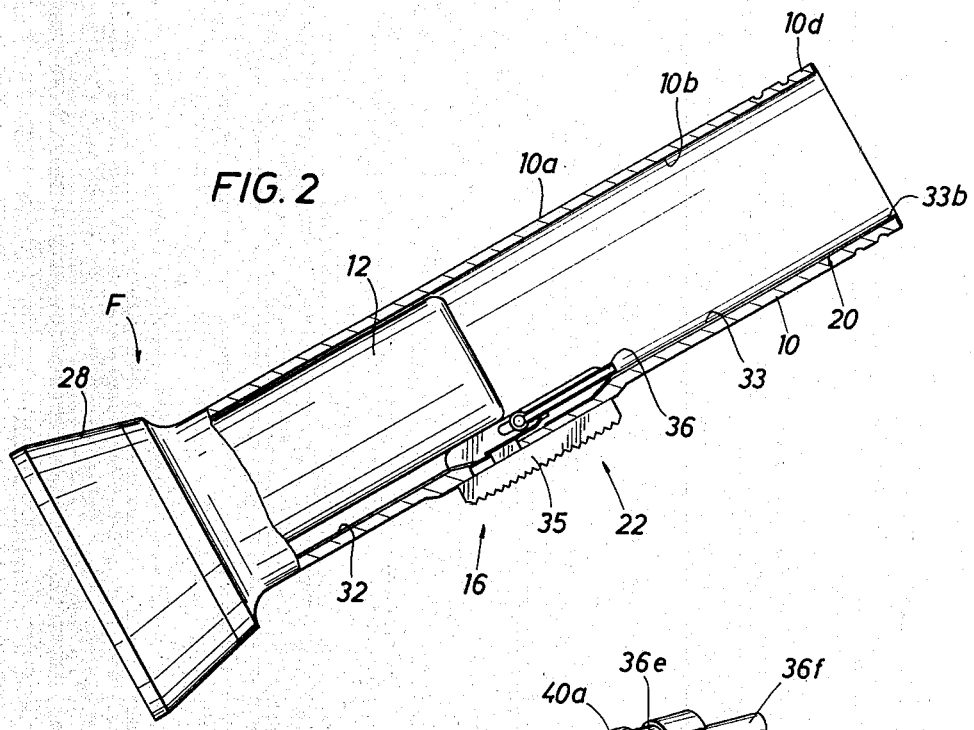
FIG. 2 is a view of the flashlight in partial cross-section in position for loading the batteries.

To load batteries in the flashlight preferred embodiment F, preferably the cap 24 and the spring 26 are removed from the housing back end 10*d*. The flashlight is turned to a position, as seen in FIG. 2, whereby the separator plate 36 rotates about axle 36*f* in mounting slots 44*a* and 44*b* to lie between mounting parts 42*a* and 42*b*. First battery 12 is inserted into the flashlight F with first battery first terminal 12*a* touching the bulb first contact 18*a*. The flashlight is then rotated approximately 180° about its longitudinal axis so that the separator plate will rotate 90° within mounting slots 44*a* and 44*b* and the metallic lining 38 will be in contact with the first battery second terminal 12*b*. Second battery 14 is then inserted into the housing 10 so that the second battery first terminal 14*a* is in contact with metallic lining 40. The spring 26 is then inserted and cap 24 is threadedly connected to complete the loading of batteries.

The foregoing disclosure and description of the invention are illustrative and explanatory thereof and various changes in the size, shape and materials as well as the details of the illustrated construction may be made without departing from the spirit of the invention.

I claim:

1. A flashlight comprising a flashlight housing, a bulb mounted with said housing, a first battery and a second battery mounted within said housing, each battery with a first terminal and a second terminal, said first and second terminals being of opposite charge, a first switch means mounted with said housing for allowing electrical communication between said first terminal of said first battery and said second terminal of said second battery when in a first position and preventing electrical communication between said first terminal of said first battery and said second terminal of said second battery when in a second position, and circuit means mounted with said housing for making an electrical circuit comprising said second battery, said first battery, said bulb and said switch, wherein the improvement comprises:

a second switch means mounted within said flashlight for separating said second terminal of said first battery from said first terminal of said second battery when in a second position and allowing electrical communication between said second terminal of said first battery and said first terminal of said second battery when in a first position.

2. The apparatus of claim 1, wherein said second switch means includes:

a separator means mounted within said housing physically and electrically separating said second terminal of said first battery from said first terminal of said second battery.

3. The apparatus of claim 2, wherein:

said second switch means is mounted with said first switch means;

when said first switch means is in said first position, said second switch is in said first position; and when said first switch means is in said second position, said second switch is in said second position.

4. The apparatus of claim 3, wherein said separator means comprises:

a separator plate made of non-conductive material with a first side and a second side;

said separator plate is substantially covered on said first side with a conductive substance;

said separator plate is substantially covered on said second side with a conductive substance;

said conductive coating of said first side is not in electrical communication with said conductive coating of said second side; and said second switch means, when in said first position, electrically connects said first side to said second side.

5. The apparatus of claim 4, wherein:

said separator plate is mounted within said housing such that said separator plate may move to a position within said housing allowing the insertion of batteries into said housing.

6. The apparatus of claim 5, wherein:

said separator plate mounted for rotational movement of approximately ninety degrees (90°) from a separating position to a loading position.

* * * * *

UNITED STATES PATENT AND TRADEMARK OFFICE

CERTIFICATE OF CORRECTION

PATENT NO. : 4,333,129

DATED : June 1, 1982

INVENTOR(S) : CHARLES W. EWING

It is certified that error appears in the above–identified patent and that said Letters Patent are hereby corrected as shown below:

At column 5, line 12, please delete the word "within" and insert therefor -- with --.

At column 6, line 25, between the words "plate" and "mounted" please insert therefor -- is --.

Signed and Sealed this

*Seventh* Day of *September 1982*

[SEAL]

*Attest:*

GERALD J. MOSSINGHOFF

*Attesting Officer*

*Commissioner of Patents and Trademarks*